US005244136A

United States Patent [19]

Collaso

[11] Patent Number: 5,244,136

[45] Date of Patent: Sep. 14, 1993

[54] EXPANDABLE WATER-PROOF POUCH

[76] Inventor: Vincent Collaso, 89 Stillwell Corner Rd., Freehold, N.J. 07728

[21] Appl. No.: 863,591

[22] Filed: Apr. 3, 1992

[51] Int. Cl.[5] ..... A45F 5/00

[52] U.S. Cl. ..... 224/253; 224/235; 224/237; 224/240; 383/61; 383/89; 383/86; 383/66

[58] Field of Search ..... 224/222, 224, 226, 228, 224/235, 236, 240, 253, 911, 909, 908, 229, 237, 241; 383/63, 66, 78, 82, 104, 120, 41, 59, 61, 84, 85, 86.1, 89, 90, 92, 99, 105, 107, 108, 123, 124, 907; 24/713.6, 713.7; 150/127, 128; 2/251, 252, 247

[56] References Cited

U.S. PATENT DOCUMENTS

| | | | |
|---|---|---|---|
| 1,671,385 | 5/1928 | Strayer | 383/90 |
| 1,690,046 | 10/1928 | Ament | 383/92 |
| 2,048,344 | 7/1936 | Lillie | 224/240 |
| 3,158,300 | 11/1964 | Withee | 224/235 |
| 3,405,863 | 10/1968 | Kugler | 383/907 |
| 4,456,122 | 6/1984 | Kalal | 383/92 |
| 4,852,783 | 8/1989 | Bryden et al. | 224/240 |
| 4,998,653 | 3/1991 | Labelle | 224/151 |
| 5,003,634 | 4/1991 | Brinkman | 224/224 |
| 5,030,013 | 7/1991 | Kramer | 383/90 |
| 5,074,300 | 12/1991 | Murphy | 383/107 |
| 5,114,061 | 5/1992 | Brady | 224/235 |
| 5,116,139 | 5/1992 | Young et al. | 383/63 |

*Primary Examiner*—Henry J. Recla
*Assistant Examiner*—Robert A. Goldman
*Attorney, Agent, or Firm*—Patrick J. Pinto

[57] ABSTRACT

An expandable water-proof pouch which is adapted for holding articles contained therein in a dry condition. This pouch being adapted for threading or attaching a belt through a belt attaching means. The pouch includes a first panel, second panel, and a bottom panel, all being made of a thin flexible waterproof material. A bead type closure means is provided in and on the first panel. A cover flap is provided to protect the closure means from unwanted opening. This pouch is also adapted to be folded and fastened to further protect the closure means.

16 Claims, 3 Drawing Sheets

EXPANDABLE WATER-PROOF POUCH

BACKGROUND OF THE INVENTION

1. Field of the Invention

With regard to the classification of art, this invention is believed to be found under the general class entitled "Package and Article Carriers", and more particularly to carriers which are belt mounted and closable. This carrier is also of the water-proof type when properly closed.

2. Description of the Prior Art

Examples of known article carriers which are designed for in water use are U.S. Pat. No. Des. 278,761, issued to Fuller on May 14, 1985; U.S. Pat . No. 4,194,655, issued to Tillotson on Mar. 25, 1980; U.S. Pat. No. 4,465,189, issued to Molsan on Aug. 14, 1985; U.S. Pat. No. 4,905,857, issued to Her on Mar. 06, 1990, and my co-pending application for a U.S. Design patent Ser. No. 07/681,074, filed Apr. 15, 1991 of which I am the sole owner.

It has been determined that a need exists for providing a water-proof pouch for carrying articles which is small when not in use. This same pouch should have the ability to expand a determined amount to hold articles which may be carried when participating in water sports. It has also been found that there is a need for an attractively styled pouch which may be worn on a belt when the user participates in social activities. And particularly those activities which may subject the user to water spray and the like in amusement parks.

With these needs in mind, the present invention is believed to fill the afore mentioned needs as well as the objects summarized below.

SUMMARY OF THE INVENTION

It is an object of this invention to provide and it does provide an article carrier which may be attached to the users belt.

It is another object of this invention to provide and it does provide a stylized article carrier which has a gusseted bottom panel which allows the pouch to expand to accept articles.

It is also an object of this invention to provide and it does provide an article carrier which has a convenient closure means for containing the articles therein in a water-proof enclosure.

It is still another object of this invention to provide and it does provide a means for protecting a closure from accidental opening with a further object of keeping the closure means free on contaminants which would effect the water-proof properties of the closure.

In addition to the above summary, the following disclosure is detailed to insure adequacy and aid in the understanding of this invention. This disclosure, however, is not intended to cover each new and inventive concept, no matter how it may be disguised, either by variations in form or additions by further improvements. For this reason, there has been chosen specific embodiments of an expandable and water-proof pouch. The pouch of the present invention may be used during water sports, at a beach, amusement park, or while hunting. These specific embodiments have been chosen for the purpose of illustration and description, as shown in the accompanying drawings wherein:

Figure 2:
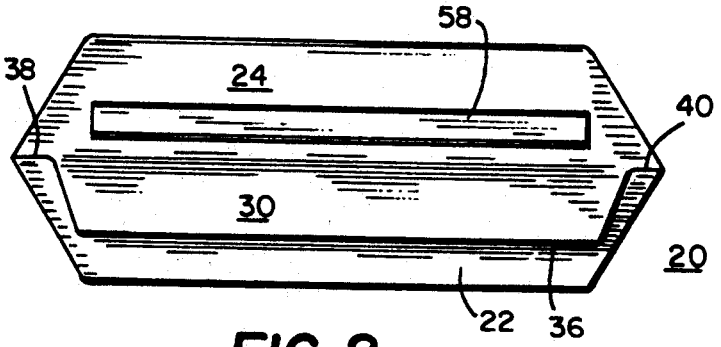
FIG. 2 represents a plan view of the embodiment of FIG. 1.
Figure 1:
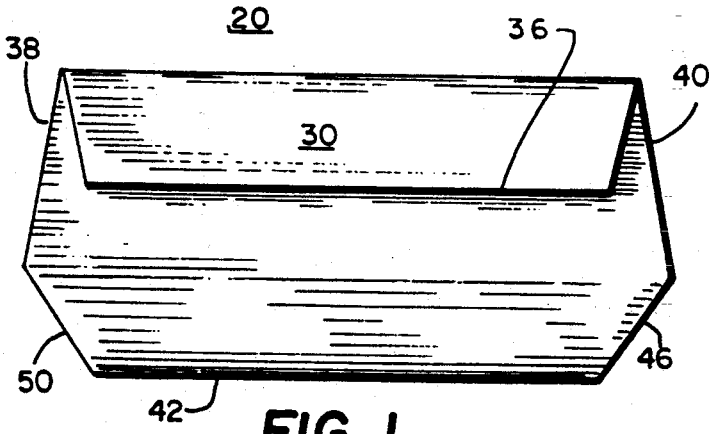
FIG. 1 represents a front elevational view of one embodiment of the present invention, this view showing the invention in an expanded condition and with a top portion in a folded condition.

In the following description and in the claims, various details and components are identified by specific names for convenience. These names are intended to be generic in their application while differentiating between the various components. Corresponding reference characters refer to like members throughout the several figures of the drawings.

The drawings accompanying and forming a part of this specification disclose details of construction for the sole purpose of explanation. It is to be understood that these structural details may be modified without departing from the concept and principles of the invention. Therefore this invention may be incorporated in forms other than shown.

DESCRIPTION OF THE FIRST EMBODIMENT

Referring to FIGS. 1 through 9, there is shown a first embodiment of the present invention. The pouch of the present invention generally identified as 20, includes a first panel 22; a second panel 24; a bottom panel 26; a closure means 28 (more clearly seen in FIGS. 8 and 9); and a cover flap 30 (seen more clearly in FIGS. 6 and 9).

Figure 6:
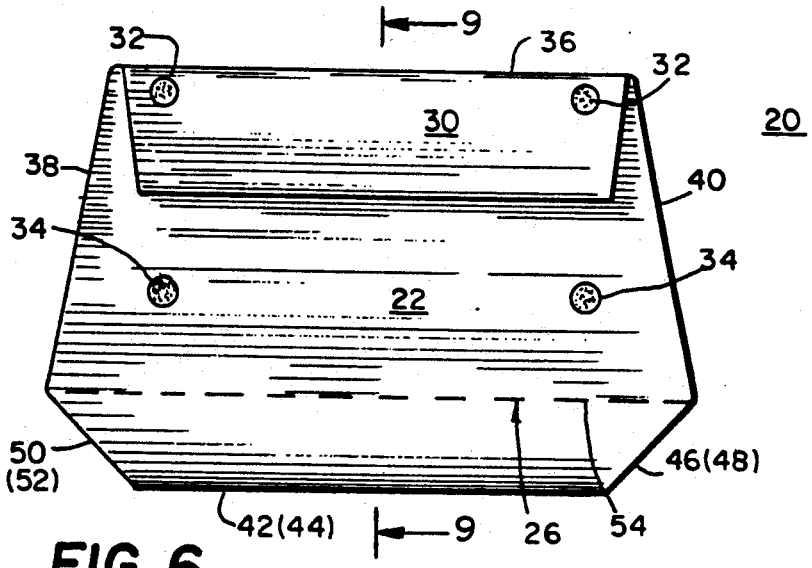
FIG. 6 represents a front elevational view of the pouch of the present invention, this view particularly showing the pouch in a flat and unfolded condition.
Figure 8:
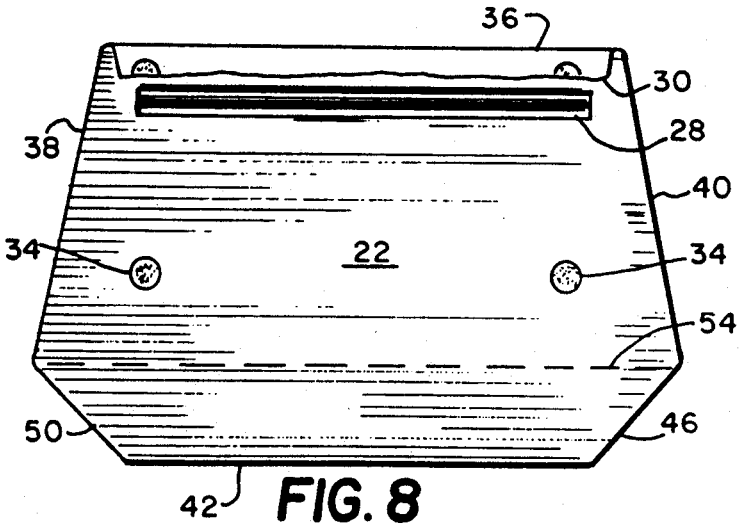
FIG. 8 represents a front elevational view of the embodiment of FIG. 6, and taken in the same direction, this view particularly having a closure flap broken away to show a closure means.

Continuing to refer to FIGS. 6 and 8, a fastening means such as a first pad 32 having a hooked surface and a second pad 34 having a looped surface. The first pad 32 and second pad 34 are commonly known as Velcro ®, with at least one mating pair being used. A strip of a hooked fastener and a matching strip of a lopped fastener may be applied to the cover flap 30 and first panel 22 respectively.

The pouch 20 is preferably made of a thin flexible water-proof material such as vinyl sheet which is compounded to maintain its flexibility when exposed to cold temperatures. The pouch 20 has a selected configuration or outline. This outline includes a top edge 36, a left edge 38, a right edge 40, a forward bottom edge 42, a rear bottom edge 44, and left inclined edges 46 and 48 (more clearly seen in FIG. 4), and right inclined edges 50 and 52 (more clearly seen in FIG. 5).

The pouch 20 must have all exposed edges of its first panel 22, second panel 24, and bottom panel 26 attached to each other in such a way so as to provided an air tight attachment.

Figure 4:
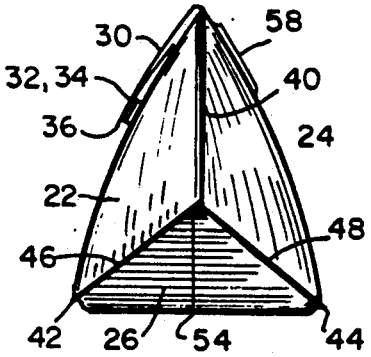
FIG. 4 represents a side elevational view of the embodiment of FIG. 1, this view being taken from the right end.
Figure 5:
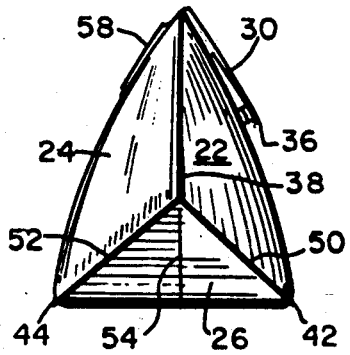
FIG. 5 is a side elevation of the embodiment of FIG. 1, this view being taken from the left end.
Figure 9:
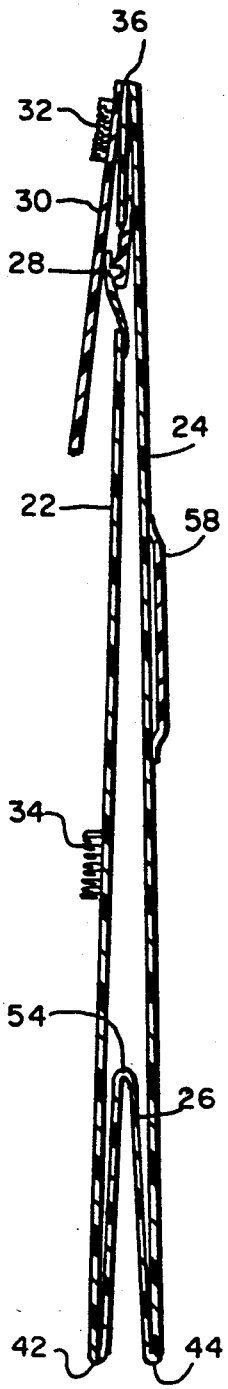
FIG. 9 represents a sectional view, in an enlarged scale this view being taken along line 9—9 of FIG. 1.
Figure 10:
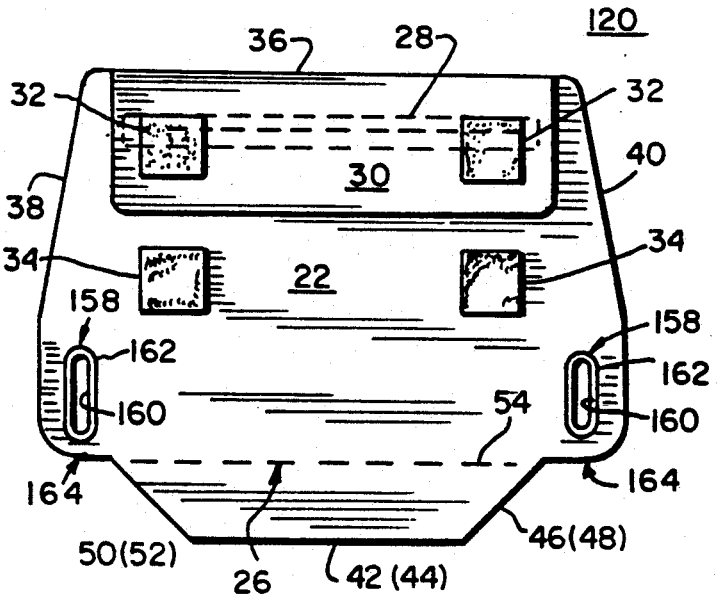
FIG. 10 represents a front elevational view of a second embodiment, this view particularly showing an alternate outline and belt attachment means.

Referring to FIG. 9, it can be seen that by folding a single sheet of the thin flexible material into a substantially W-shape that bottom edges 42 and 44 as well as interior edge 54 are already attached. The balance of the edges will require attachment by welding, fusing, or other suitable means. It is to be noted that the closure means 28 is attached to the first panel 22 at its selected location prior to forming the pouch 20. The cover flap 30 is attached along the top edge 36 as and when the first panel 22 is attached to the second panel 24. It is also to be noted that edges 46 must not be attached to edge 48 and edge 50 must not be attached to edge 52. This is necessary so that the pouch 20 can be expanded as shown in FIGS. 4 and 5. It is also to be noted that the edges 46, 48, 50, and 52 are inclined at an angle of 45 degrees to allow a desired expanding ratio. Other angles of incline may be selected to suit a particular need.

Figure 3:
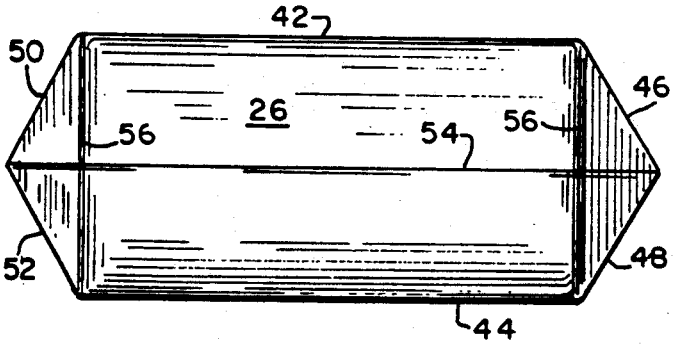
FIG. 3 represents a bottom view of the embodiment of FIG. 1., this view particularly showing an expanded bottom panel.

Referring now to FIG. 3, the bottom panel 26 may have a series of folding lines impressed thereon. These folding lines are identified as 56. These lines aid in the folding of the pouch to a substantially flat condition.

Figure 7:
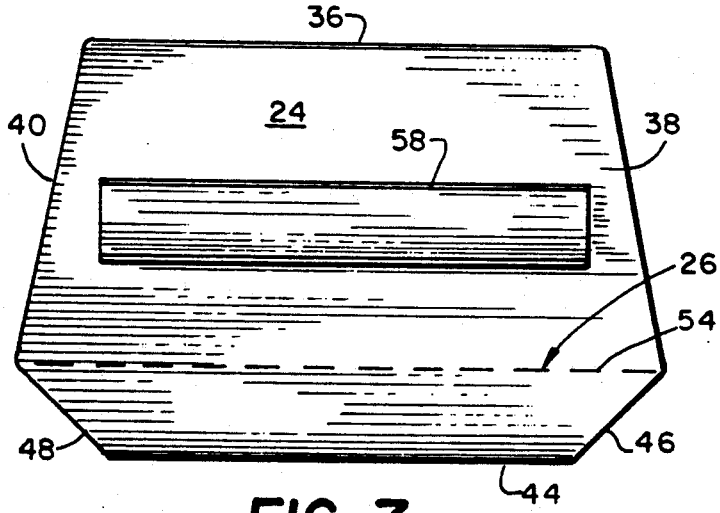
FIG. 7 represents a rear elevational view of the embodiment shown in FIG. 6., this view particularly showing one belt attachment means.

Referring now to FIGS. 2, 7 and 9, a belt attaching means 58 is shown as an elongated passage formed on the second panel 24. This belt attaching means is sized to allow a belt to be threaded or passed therethrough.

Referring now to FIG. 9, it can be seen that the cover flap 30 provides a covering for the closure means 28. The preferred closure means is a plastic zipper type, having a bead type seal. The cover flap 30 provides protection to the closure means 28 from accidentally or unwanted opening. This cover flap 30 also provides a means for locking the closure means 28 by pressing the closure seal into a sealed condition without friction. This lack of friction results in a smooth closure of the sealing means 28 without unwanted buckling of the mating surfaces. This cover flap also aids in keeping the closure means 28 free of contaminants.

EMBODIMENT OF FIG. 10

A second embodiment for an expandable water-proof pouch, generally identified as 120, is shown. This pouch 120 includes a first panel 22, a second panel 24, and a bottom panel 26 which are similar to their corresponding panels described in connection with pouch 20. The main difference distinguishing pouch 120 from pouch 20 is in the type of belt attaching means used. This second belt attaching means has been generally identified as 158. This belt attaching means 158 includes at least two elongated apertures 160 which are formed in and through the first panel 22 and second panel 24. The interior edges of the first panel 22 and second panel 24 around each aperture 160 must be welded or fused to provide an air-tight attachment. This fusing of the edges of apertures 160 also provides a reinforcement of the material when a belt, not shown, is attached or threaded therethrough. It is preferred that a grommet 162 be used to reinforce the apertures 160. This grommet 162 is preferably of a corrosive resistant material such as plastic and adapted for fusing to the pouch panels 22 and 24, but other materials may be used.

An extending ear portion 164 is formed at or above the intersection of edges 46, 48, and 54, when the pouch is in a flattened condition.

Figure 11:
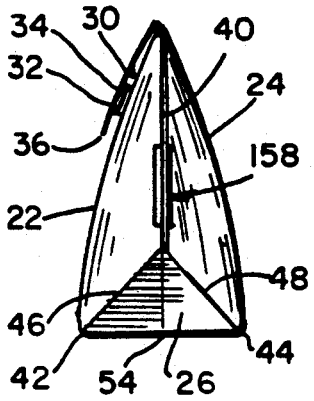
FIG. 11 represents a side elevational view of the embodiment of FIG. 10, in an expanded condition.
Figure 12:
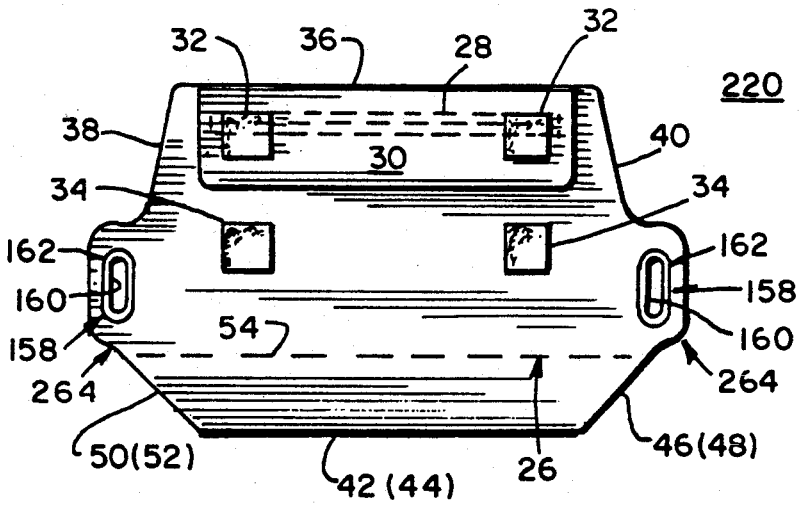
FIG. 12 represents a front elevational view of a third embodiment, this view particularly showing a third peripheral outline.
Figure 13:
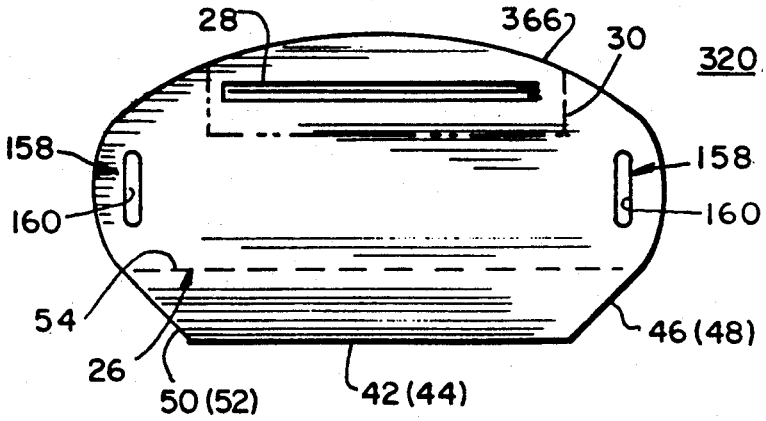
FIG. 13 represents a front elevational view of a fourth embodiment of the present invention, this view particularly showing yet another outline configuration.

A similar ear 164 is also formed at the intersection of edges 50, 52, and 54. These ears 164 are provided to allow the pouches 120 and 20 to have substantially the same expanded capacity. This is shown more clearly in comparing FIG. 11 to FIG. 4.

EMBODIMENT OF FIG. 12

A third embodiment for an expandable water-proof pouch is generally identified as 220. This pouch 220 is characterized by its ear portions 264 which extend on one side from edges 40, 46, and 48; and on the other side extending from edges 38, 50, and 52. Each ear 164 is formed preferably at or above the edge 54 when the pouch 220 is in a flattened condition. An aperture 160 is formed in and through first panel 22 and second panel 24. A grommet 162 is preferably used to reinforce the elongated aperture 160 for maintaining an air-tight seal. It is to be noted that the entire surface of the extending ear may be fused to alternatively provide the desired sealing characteristics and reinforcement.

EMBODIMENT OF FIG. 13

A fourth configuration for an expandable pouch is generally identified as 320. This configuration is characterized as having a first panel 22, a second panel 24, and a bottom panel 26. This pouch 320 differs from the other pouches previously described. The difference being that a substantially continuous curved edge 366 extends from edges 46, and 48 to edges 50 and 52. This pouch 320 may have a belt attachment means such as belt attachment means 158 formed at opposing ends along or near its major axis. When belt attaching means 158 is used, it must be formed above the plane of edge 54 as previously noted to allow expansion. This pouch 320 preferably has a cover flap 30 as shown in dashed outline. Pouch 320 may have a belt attaching means 58 substituted for attaching means 158.

Each of the pouches 20, 120, 220, and 320 employ a bottom panel 26 which is configured in a gusseted fashion for expansion as and when desired. The closure means 28 preferably is located at a point near the top edge 36 or edge 366 for access.

The thin flexible material used for the first panel 22, second panel 24, bottom panel, 26 and cover panel 30 may be solid in color. The material may have a decorative design or printing thereon. A vinyl sheeting has been suggested above because of its properties and cost, but other thin flexible water-proof materials may be used.

The pouches 20, 120, and 220 are adapted for being folded substantially as shown in FIGS. 1 through 5 and FIG. 11. The folded condition is maintained by the selective placement and use of hook and loop fasteners. This folded condition provides a double protection with the cover flap 30 for the closure means. This double protection resists the accidental opening of the closure means 28.

It is to be noted that the outline of the pouches 20, 12, 220, and 320 is trimmed simultaneously during the edge fusing process which results in an economical manufacturing process.

Typically the pouch 20, 120, 220, or 320 will have a belt, not shown, threaded through its associated belt attaching means 58 or 158. The belt allows the pouch to be removably fastened around the torso of the user. As previously mentioned, the folding capability and the fastener means provide protection to the contents interior or the bag, by preventing accidental opening of the closure means 28 when the user participates in water sports or activities.

Terms such aS "left", "right", "up", "down", "bottom", "top", "front", "back", "in", "out", and the like are applicable to the embodiments shown and described in conjunction with the drawings. These terms are merely for the purpose of description and do not necessarily apply to the position in which the lifting and tilting apparatus of the present invention may be utilized.

While these particular embodiments of an improved expandable water-proof pouch have been shown and described, it is to be understood that the invention is not limited thereto and protection is sought to the broadest extent the prior art allows.

What is claimed is:

1. An expandable water-proof pouch which is adapted for holding articles therein, said expandable water-proof pouch being further adapted for attachment to a belt, said expandable water-proof pouch including:

(a) a first panel, a second panel, and a bottom panel, said first panel and said second panel having a substantially identical peripheral configuration, said bottom panel having a selected peripheral outline for forming a gusset so that said expandable water-proof pouch may be brought to a substantially flattened condition, said first panel said second panel, and said bottom panel being of a flexible water-proof material, each of said first panel, said second panel, and said bottom panel being attached continuously along all adjoining and common peripheral edges in a substantially air-tight seal;

(b) a closure means being placed in an opening through an upper portion of said first panel, said closure means being flexible and adapted for allowing flexure of said first panel when said closure means is in a locked and substantially air-tight condition, said closure means being further adapted for allowing selective access to an interior portion of said water-proof pouch;

(c) at least one belt attachment means for allowing belt attachment; and wherein said waterproof pouch further includes at least one fastening means for holding said waterproof pouch in a folded condition for protecting said closure means from accidental and unwanted opening.

2. A pouch as recited in claim 1 which further includes a cover flap which is of a flexible material, said cover flap being attached at a top edge of said pouch, said cover flap being of a selected size for fully covering said closure means, said cover flap providing an additional protection against said unwanted opening of said closure means.

3. A pouch as recited in claim 1 wherein said first panel, said second panel, and said bottom panel are of a unitary piece of sheet material, said unitary piece being folded into a substantially W-shape for providing said air-tight seal along a bottom edge of each of the first panel and the second panel.

4. A pouch as recited in claim 1 wherein said belt attachment means includes an elongated belt guide which is selectively positioned and attached to an exterior of said second panel.

5. A pouch as recited in claim 1 wherein said belt attachment means includes at least two elongated apertures, each of said apertures being formed in and through said first panel and said second panel, exposed edges of each of said apertures of respective first and second panels being attached to provide an air-tight seal.

6. A pouch as recited in claim 5 wherein said apertures have a reinforcement means.

7. A pouch as recited in claim 6 wherein said reinforcement means includes a grommet.

8. A pouch as recited in claim 7 wherein said grommet is made of a plastic material for fusing to said first panel and said second panel.

9. An expandable water-proof pouch which is adapted for holding articles therein, said expandable water-proof pouch being further adapted for attachment to a belt, said expandable water-proof pouch including:

(a) a first panel, a second panel, and a bottom panel, said first panel and said second panel having a substantially identical peripheral configuration, said bottom panel having a selected peripheral outline for forming a gusset so that said expandable water-proof pouch may be brought to a substantially flattened condition, said first panel, said second panel, and said bottom panel being of a flexible water-proof material, each of said first panel, said second panel, and said bottom panel being attached continuously along all adjoining and common peripheral edges in a substantially air-tight seal;

(b) a closure means being placed in an opening through an upper portion of said first panel, said closure means being flexible and adapted for allowing flexure of said first panel when said closure means is in a locked and air-tight condition, said closure means being further adapted for allowing selective access to an interior portion of said water-proof pouch;

(c) at least one belt attachment means for allowing belt attachment;

(d) at least one fastening means for holding said water-proof pouch in a folded condition, said folded condition being parallel to said closure means for providing protection against accidental and unwanted opening of said closure means; and wherein said peripheral configuration of each of said first panel and said second panel includes a bottom edge, a first inclined edge extending from one end of each of said bottom edges, and a second inclined edge extending from a second end of each of said bottom edges, each of the bottom edges, said first inclined edges, and said second inclined edges adjoin said bottom panel.

10. A pouch as recited in claim 9 which further includes a cover flap which is of a flexible material, said cover flap being attached along a top edge of said pouch, said cover flap being of a selected size for fully covering said closure means, said cover flap providing an additional protection against accidental opening of said closure means.

11. A pouch as recited in claim 9 wherein said first panel, said second panel, and said bottom panel are of a unitary piece of sheet material, said unitary piece being folded into a substantially W-shape for providing said air-tight seal along a bottom edge of each of the first panel and the second panel.

12. A pouch as recited in claim 9 wherein said belt attachment means includes an elongated belt guide which is selectively positioned and attached to an exterior of said second panel.

13. A pouch as recited in claim 9 wherein said belt attachment means includes at least two elongated apertures, each of said apertures being formed in and through said first panel and said second panel, exposed edges of each of said apertures of respective first and second panels being attached to provide an air-tight seal.

14. A pouch as recited in claim 13 wherein said apertures have a reinforcement means.

15. A pouch as recited in claim 14 wherein said reinforcement means includes a grommet.

16. A pouch as recited in claim 15 wherein said grommet is made of a plastic material for fusing to said first panel and said second panel.

* * * * *